United States Patent [19]

Miyagawa et al.

[11] 4,201,131

[45] May 6, 1980

[54] SEALING DEVICE FOR USE IN A NOTE COUNTING MACHINE

[75] Inventors: Tuyoshi Miyagawa; Eiichi Kokubo; Minoru Yoshida, all of Tokyo, Japan

[73] Assignee: Laurel Bank Machine Co., Ltd., Tokyo, Japan

[21] Appl. No.: 951,142

[22] Filed: Oct. 13, 1978

[51] Int. Cl.[2] ..... G06M 9/02; B41K 5/08

[52] U.S. Cl. ..... 101/4; 101/41; 235/92 SB

[58] Field of Search ..... 235/92 SB; 101/4, 35, 101/41

[56] References Cited

U.S. PATENT DOCUMENTS 3,795,796 3/1974 Shigemori et al. ..... 235/92 R X

FOREIGN PATENT DOCUMENTS 52-100793 7/1977 Japan ..... 101/35

*Primary Examiner*—Clifford D. Crowder

*Attorney, Agent, or Firm*—Fleit & Jacobson

[57] ABSTRACT

There is provided a sealing device for use in a note counting machine. A note holder which has a note supporting plate with an arcuate slot is mounted on a rotary shaft. A supporting arm having a cylinder portion in which a seal impression holder is vertically movable through the arcuate slot is pivotably mounted on the rotary shaft. A seal impression holder driving means drives the seal impression holder through the movement of the supporting arm just after the counting has been completed.

3 Claims, 4 Drawing Figures

SEALING DEVICE FOR USE IN A NOTE COUNTING MACHINE

Figure 1:
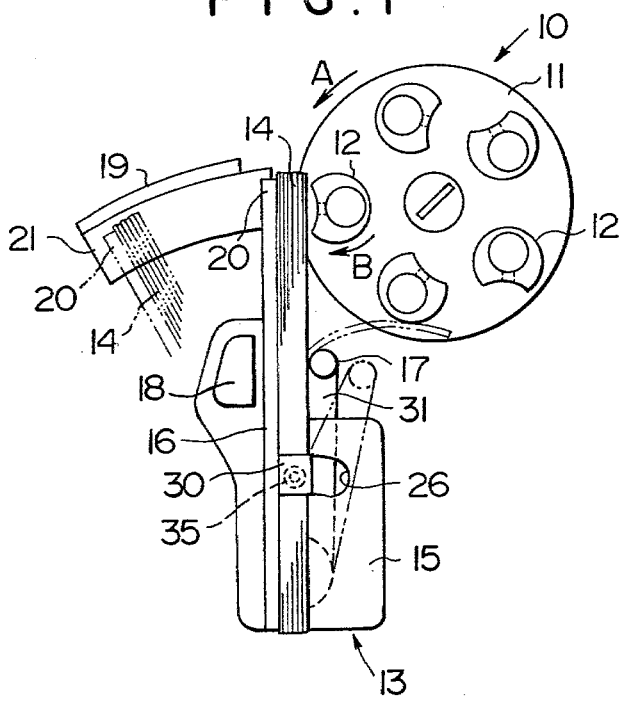

This invention relates to a sealing device for use in a note counting machine.

A bunch of notes which has been counted is usually affixed with a seal, which indicates a predetermined number of notes, on the sealing tape by which the bunch of notes is wrapped or sealed. It is known to the skilled in the art to affix a seal on the sealing tape by utilizing a seal device provided in a note counting machine. Japanese Utility Model Laid Open Publication 100793/1977 discloses such a sealing device wherein the note holder in the counting section of the note counting machine is provided on the note supporting plate thereof with a slot, and the seal impression held within the seal impression holder is driven upwardly to project through the slot and affix a seal on the sealing tape by which the bunch of notes is wrapped, with the bunch of notes being held by the note holder. In the device of the Publication, the means for driving the seal impression holder is provided independently of the supporting arm. The supporting arm has a pressing rod which is outwardly pushed to be rotated by the deflection of the notes whereby the notes are counted and is returned to the initial counting position when the counting has been completed. The bunch of notes is moved together with such a movement of the pressing rod. Therefore, if the seal impression holder driving means is energized just after the counting has been completed, the affixed seal is aberrated due to the movement of the bunch of notes and a fresh and clean seal cannot be obtained. In this instance, in order to avoid aberration, it is necessary to provide a certain period of time to affix a seal after the pressing rod has returned to the initial counting position. This results in extra time and a complicated circuit for actuating the seal impression holder driving means.

Therefore, one of the main objects of the invention is to provide a new sealing device for use in a note counting machine whereby a fresh and clean seal is obtained.

Another object of the invention is to provide a new sealing device for use in a note counting machine wherein no extra time for driving a seal impression holder driving means and no complicated circuit are necessitated.

According to the present invention, there is provided "A sealing device for use in a note counting machine wherein a bunch of notes wrapped by a sealing tape is held by a note holder in a counting section of the note counting machine and is counted by being deflected one at a time by suction shafts provided on a rotary cylinder which comprises, a note holder mounted on a rotary shaft adjacent the rotary cylinder and including a note supporting plate for supporting the bunch of notes and an upstanding plate vertically connected to said note supporting plate, said note supporting plate being provided with an arcuate slot about said rotary shaft, a supporting arm pivotably mounted on said rotary shaft and including a vertical pressing rod provided on the end of the supporting arm and a cylinder portion which substantially lies below said arcuate slot of said note supporting plate, said pressing rod vertically holding the bunch of notes together with said upstanding plate of said note holder, a seal impression rigidly mounted within a seal impression holder which is positioned within said cylinder portion of said supporting arm and is vertically movable through said arcuate slot, and means for vertically driving said seal impression holder to affix a seal on a sealing tape of the bunch of notes at the bottom side thereof."

Figure 2:
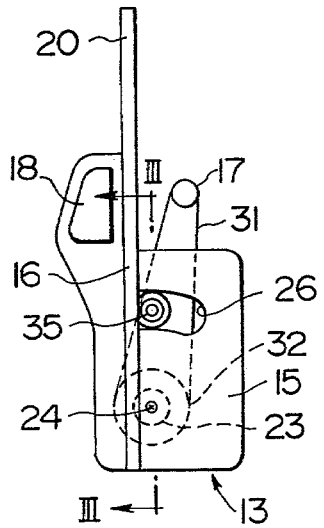
Figure 3:
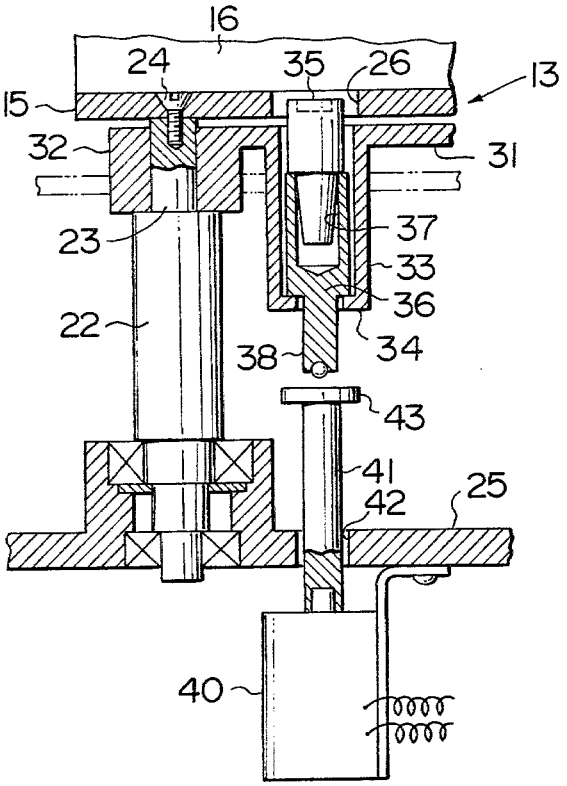
Figure 4:
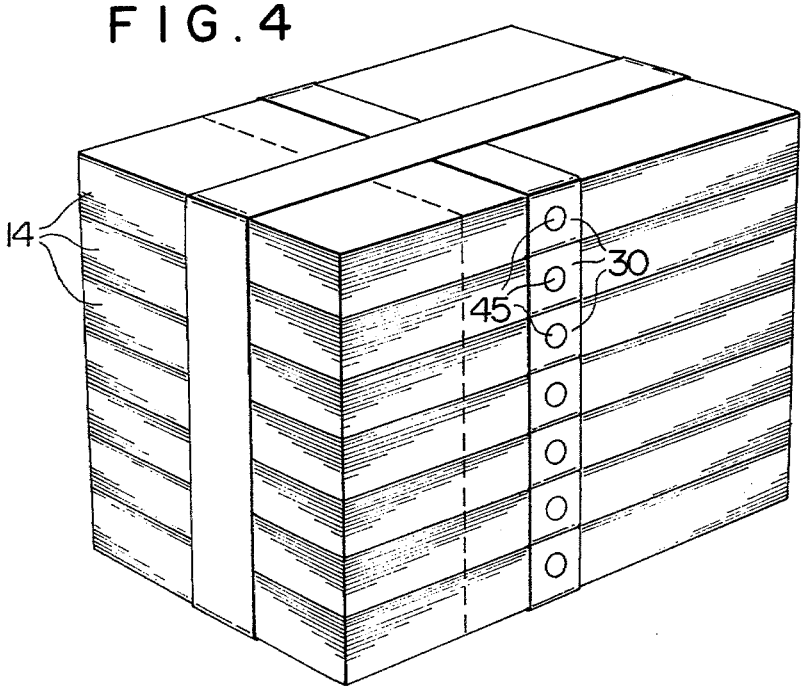

The other object of the invention will become apparent to those skilled in the art from the following description, taken in connection with the accompanying drawings wherein;

FIG. 1 is a top plan view showing the counting section of a note counting machine according to the present invention, FIG. 2 is a top plan view showing a note holder mechanism provided in the counting section, FIG. 3 is an enlarged vertically cross-sectional view taken along the lines III—III of FIG. 2, and FIG. 4 is a perspective view showing stacked bunches of notes with each bunch of notes having a sealing tape on which a sealing has been affixed by a sealing device according to the present invention.

There is shown in FIG. 1 a counting section generally indicated at 10 of a note counting machine. In the counting section 10, a rotary chamber 11 which is constructed to be rotated in the direction of arrow A is provided. Mounted on the upper surface of the rotary cylinder 11 are a plurality of suction shafts 12, each of which is constructed to be rotated in the direction of arrow B. A note holder generally indicated at 13 is disposed adjacent to the rotary cylinder 11 and is constructed to be pivotable between the counting position and the non-counting position or to note charging and the note discharging position, hereinafter referred to in more detail. The note holder 13 consists of a note supporting plate 15 for supporting a bunch of notes 14 wrapped by a sealing tape 30 on its upper surface and an upstanding plate 16 attached perpendicularly to the note supporting plate 15 at the upper surface thereof. The upstanding plate 16 functions so as to be engaged with the bunch of notes 14 at its side surface when the bunch of notes 14 is charged in a charging position and to clamp the bunch of notes 14 together with a pressing rod 17 of a supporting arm 31, which is hereinafter referred to in more detail, during the counting operation.

A start button 18 for starting the counting operation is provided on the note supporting plate at the upper surface thereof behind the upstanding plate 16.

A guide plate 19 is provided along the path in which the end portion 20 of the upstanding plate 16 is swung. Connected to the underside of the guide plate 19 is a note receiving plate 21 for supporting the end portions of the bunch of notes 14 when the bunch of notes is charged in the note holder 13 in a non-counting position as shown by the dotted line of FIG. 1 and provides a surface on which the bunch of notes 14 is slidable when the note holer 13 is pivotally moved toward and away from a counting position as shown by the solid line of FIG. 1.

As will be apparent from FIGS. 2 and 3, the note supporting plate 15 is connected by a screw 24 to the reduced portion 23 of a vertical rotary shaft 22 which is pivotably mounted on a frame 25 of the note counting machine. The note supporting plate 15 is provided with an elongated arcuate slot 26 about the rotary shaft 22 so that the arcuate slot 26 lies under the sealing tape by which the bunch of notes 14 is wrapped in a counting position.

A supporting arm 31 is rotatably mounted at the base portion 32 thereof on the reduced portion 23 of the rotary shaft 22. The supporting arm 31 is formed at the end thereof with the pressing rod 17 which is biased toward the upstanding plate 16 and functions to clamp the bunch of notes 14 between the pressing rod and the upstanding plate in a counting position. As the notes are counted in such a manner that the end portions of the notes are deflected one at a time by the suction shaft 12 as shown by the dotted line of FIG. 1, the pressing rod is, as shown by the dotted lines of FIG. 1, pushed outwardly by the deflected portions of the notes in a direction away from that of the upstanding plate 16. After the counting has been completed, the pressing rod returns to the initial counting position as shown by the solid line of FIG. 1.

The supporting arm is formed with a hollow cylinder portion 33 which has an apertured bottom plate 34 so that the cylinder portion lies under the arcuate slot 26.

A seal impression holder 36 which rigidly receives a seal impression 35 within the hole 37 formed in the top portion of the seal impression holder 36 is nested but vertically movable within the cylinder portion 33 of the supporting arm 31. The tongue portion 38 of the seal impression holder 36 downwardly projects through the aperture of the bottom plate 34.

A solenoid 40 is provided below the frame 25 thereon. The actuator 41 of the solenoid 40 upwardly projects through the aperture 42 formed on the frame 25 and has formed at its top end portion an operating plate 43 which is wide enough to be able to support the bottom of the seal impression holder 36 no matter what the position of the supporting arm.

When the solenoid 40 is energized, the actuator 41 thereof is moved upwardly and causes the operating plate 43 to push the seal impression holder 36. The circuit is preferably made so that the solenoid is energized just after the counting operation has been completed since no extra time and no complicated circuit are required. Instead of the solenoid, a pneumatic or hydraulic mechanism may be used in order to move the actuator 41.

In operation, the bunch of notes 14 on which the sealing tape is wrapped is set in the note holder 13 in a non-counting position as shown by the dotted line of FIG. 1. In setting, the sealing tape 30 is located so that when the holder 13 comes to the counting position, the sealing tape 30 comes above the arcuate slot 26.

When the start buttom 18 is depressed, the note holder 13 is rotated in a clockwise direction about the rotary shaft 22 into the counting position as shown by the solid line of FIG. 1. The bunch of notes 14 is thus clamped between the upstanding plate 16 and the pressing rod 17. As the rotary cylinder 11 and the suction shafts 12 deflect the notes 14 one at a time in a conventional manner as shown by the dotted line of FIG. 1 so as to count the notes, the pressing rod 17 is pushed outwardly by the deflected notes. In this condition, the seal impression 14 lies below the level of the arcuate slot 26.

When the counting operation has been completed, the pressing rod 17 returns to the initial position as shown by the solid line of FIG. 1. Simultaneously with the completion of the counting operation, the solenoid 40 is energized and the actuator 41 with the operating plate 43 is moved upwardly. Consequently, the operating plate 43 upwardly pushes the seal compression holder 36 in which is rigidly held the seal impression 35. Therefore, a seal is affixed on the sealing tape 30 at the bottom side thereof. Thereafter, the solenoid 40 is deenergized and the seal impression holder 36 moves downwardly together with the movement of the actuator 41.

In this instance, although the bunch of notes 14 is deflected during the counting operation, since the seal impression holder 36 is disposed in the cylinder portion 33 of the supporting arm 31 and, therefore, the seal impression 35 held by the seal impression holder 36 is moved in time relationship with the supporting arm 31 which in turn is moved by the deflection of the bunch of notes, the seal impression 35 affixes a seal on the sealing tape 30 without any aberration.

After the seal is affixed, the note holder 13 is moved to the non-counting position, and the bunch of notes is withdrawn from the note holder 13.

FIG. 4 shows stacked bunches of notes with each bunch having a sealing tape 30 on which a seal 45 is affixed.

As will be seen, all seals 45 on the sealing tape can be seen at a glance and there is no necessity to move the bunches of notes.

What is claimed is:

1. A sealing device for use in a note counting machine wherein a bunch of notes wrapped by a sealing tape is held by a note holder in a counting section of the note counting machine and the notes composing the bunch are counted by being deflected one at a time by suction shafts provided on a rotary cylinder which comprises, a note holder mounting on a rotary shaft adjacent to the rotary cylinder and including a note supporting plate for supporting the bunch of notes and an upstanding plate vertically connected to said note supporting plate, said note supporting plate being provided with an arcuate slot about said rotary shaft, a supporting arm pivotably mounted on said rotary shaft and including a vertical pressing rod provided on the end of the supporting arm and a cylinder portion which substantiary lies below said arcuate slot of said note supporting plate, said pressing rod vertically holding the bunch of notes together with said upstanding plate of said note holder, a seal impression rigidly mounted within a seal impression holder which is positioned within said cylinder portion of said supporting arm and is vertically movable through said arcuate slot, and means for vertically driving said seal impression holder to affix a seal on a sealing tape of the bunch of notes at the bottom side thereof.

2. A sealing device as set forth in claim 1 wherein said seal impression holder driving means is energized just after the counting has been completed.

3. A sealing device as set forth in claim 1 wherein said seal impression holder driving means has a wide operating plate to upwardly push said seal impression holder during the movement of said supporting arm.

* * * * *